US005170542A

United States Patent [19]

Greenberg

[11] Patent Number: 5,170,542

[45] Date of Patent: Dec. 15, 1992

[54] JEWELRY CLUTCH

[76] Inventor: William H. Greenberg, 23 Sylvia La., Lincoln, R.I. 02865

[21] Appl. No.: 605,683

[22] Filed: Oct. 29, 1990

[51] Int. Cl.[5] ..... A44C 7/00

[52] U.S. Cl. ..... 24/705; 24/706.9; 63/12

[58] Field of Search ..... 24/705, 706.9, 108, 24/10 R; 63/12, 14.5

[56] References Cited

U.S. PATENT DOCUMENTS

| | | | |
|---|---|---|---|
| 1,024,563 | 4/1912 | Eckhart | 24/706.9 |
| 2,040,289 | 5/1936 | Adams | 24/706.9 |
| 3,056,180 | 10/1962 | Gink | 24/10 R |
| 3,698,044 | 10/1972 | Chernow | 24/706.9 |
| 3,945,089 | 3/1976 | Gagnon | 24/705 |
| 4,610,149 | 9/1986 | Ireland | 63/12 |
| 4,630,452 | 12/1986 | Connelly et al. | 63/12 |
| 4,688,400 | 8/1987 | Chioffe | 63/12 |
| 4,907,425 | 3/1990 | Elkin | 63/12 |
| 4,920,671 | 5/1990 | Batkos | 63/12 |
| 4,928,367 | 5/1990 | Seidman | 24/705 |

*Primary Examiner*—Victor N. Sakran

*Attorney, Agent, or Firm*—Salter, Michaelson & Benson

[57] ABSTRACT

A jewelry clutch includes a body portion having an open cavity formed therein and an elastomeric clutch element in the cavity for receiving and securing a post of a jewelry item in the clutch. The body portion has a substantially triangular transverse cross sectional configuration to enable the clutch to be more easily grasped between the thumb and first two fingers of a hand of a user.

7 Claims, 2 Drawing Sheets

JEWELRY CLUTCH

BACKGROUND AND SUMMARY OF THE INVENTION

The instant invention relates to jewelry and more particularly to a jewelry clutch which is adapted to be effectively and easily grasped with the thumb and the first two fingers of a hand of a user.

A wide variety of jewelry clutches have been heretofore available for applications such as for securing the posts of pierced earrings to the earlobes of wearers. In this regard, one of the most common types of heretofore available jewelry clutches which is commonly known as the barrel clutch includes a sheet metal housing of substantially circular cross section having an aperture therein and an elastomeric clutch element in the housing. A clutch of this type is operative by inserting the post of a jewelry item, such as a pierced earring, into the aperture in the housing so that the elastomeric element in the housing releasably grasps the post to retain the clutch on the post. Other types of jewelry clutches and related elements which, in addition to the barrel clutch, represent the closest prior art to the subject invention of which the applicant is aware are disclosed in the U.S. Patents to CONNELLY et al U.S. Pat. No. 4,630,452, ELKIN U.S. Pat No. 4,907,425 and GAGNON U.S. Pat. No. 3,945,089. However, while a variety of different types of jewelry clutches have been heretofore available, the heretofore available clutches have generally all been found to have one major drawback. Specifically, it has been found that the heretofore available clutches are generally difficult to manipulate and grasp with the fingers of a user because of their relatively small size and generally rounded configurations. Consequently, it has been found that it often is difficult for a user to grasp and manipulate a jewelry clutch so that it can be assembled on a post of a jewelry item, particularly when this assembly procedure is carried out on the backside of a user's earlobe.

The instant invention provides a new and improved jewelry clutch which is adapted to be more easily grasped and manipulated by a user as it is assembled with a post of a jewelry item, such as a pierced earring. Specifically, the clutch of the instant invention comprises a body portion having a longitudinal axis and means for releasably receiving and securing a jewelry post in the body portion so that the post extends substantially along the longitudinal axis of the body portion. The body portion has a substantially triangular sectional configuration, and accordingly, the body portion can be more effectively grasped with the thumb and first two fingers of a hand of a user. The body portion is preferably of substantially equilateral triangular configuration, and the outer surface of the body portion preferably extends in substantially parallel relation to the longitudinal axis thereof. Further, the body portion preferably has a groove on the outer surface thereof which extends substantially completely around the body portion. The groove is adapted for receiving a fingernail of a user to further facilitate grasping of the clutch by the user as the clutch is manipulated to secure it on or remove it from the post of a jewelry item. The body portion preferably has longitudinally opposite first and second ends, and it preferably has a cavity formed therein which extends inwardly from a first end thereof, and the means for releasably securing a jewelry clutch preferably comprises an elastomeric clutch element which is received in the cavity in the body portion. The clutch preferably still further comprises an enlarged face plate on the first end of the body portion having a central aperture therein which is substantially aligned with the axis of the body portion. Further, the face plate preferably has a circumferential dimension which is greater than the transverse cross sectional dimension of the body portion adjacent the first end thereof.

It has been found that the clutch of the instant invention can be effectively utilized for receiving and securing a post of a jewelry item, such as a pierced earring in order to secure the jewelry item on a user. Specifically, because the body portion is of triangular configuration, the three sides of the body portion can effectively and comfortably fit between the thumb and first two fingers of a hand of a user so that the user can more easily grasp and manipulate the body portion. Further, because the clutch preferably has a groove therein which extends around the body portion, the clutch can be still more effectively grasped by a user by inserting a fingernail into the groove. Still further, because the clutch preferably includes an enlarged plate portion on one end of the body portion, the clutch can more effectively provide a backing for the rear surface of an earlobe of a user in order to reduce the stresses on the earlobe resulting from the clutch.

Accordingly, it is a primary object of the instant invention to provide an improved jewelry clutch which is adapted to be more easily grasped in a hand of a user.

Another object of the instant invention is to provide an improved jewelry clutch having a body portion of substantially triangular configuration.

An even still further object of the instant invention is to provide a jewelry clutch having a body portion of substantially triangular configuration and a groove in the outer surface of the body portion which is adapted for receiving a fingernail of a user therein.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated carrying out the present invention.

DESCRIPTION OF THE INVENTION

Figure 1:
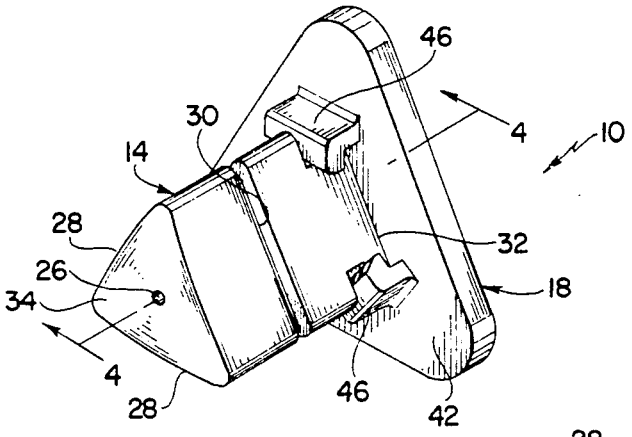
FIG. 1 is a perspective view of a first embodiment of the clutch of the instant invention.
Figure 2:
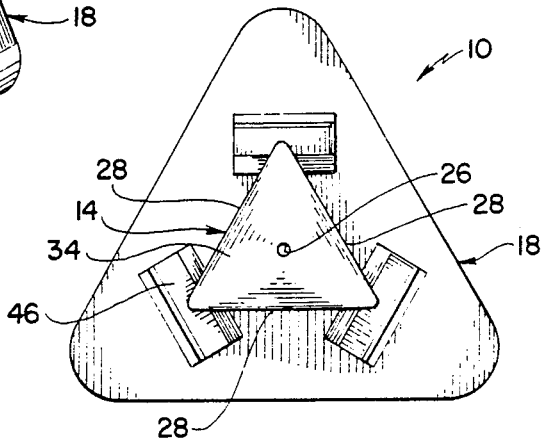
FIG. 2 is an end view thereof.
Figure 3:
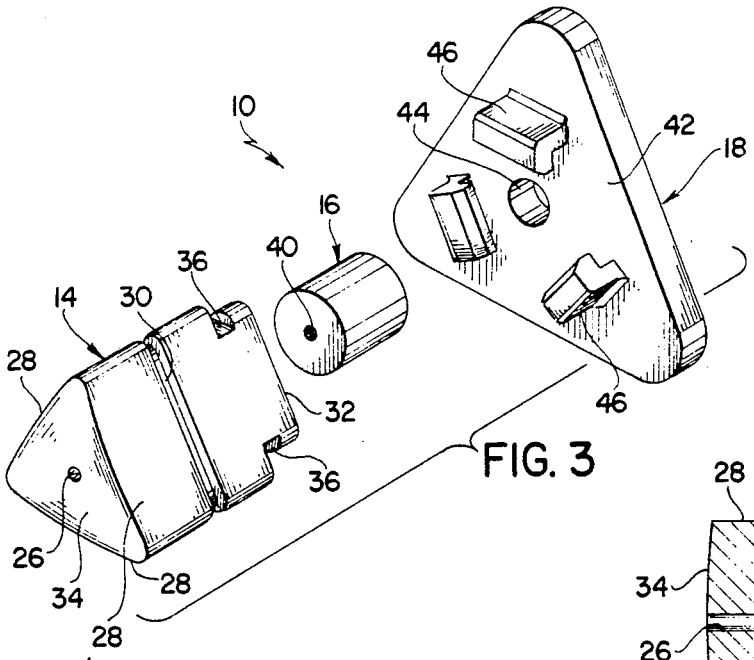
FIG. 3 is an exploded perspective view thereof.
Figure 4:
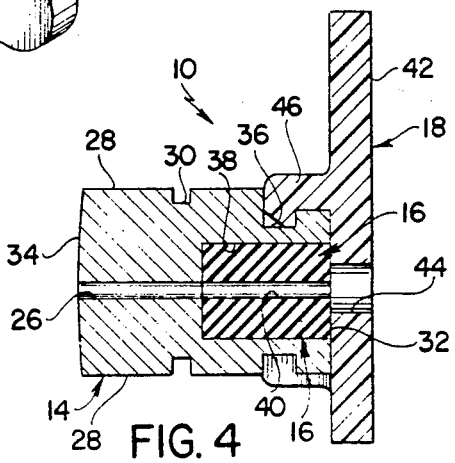
FIG. 4 is a sectional view taken along line 4—4 in FIG. 1.
Figure 5:
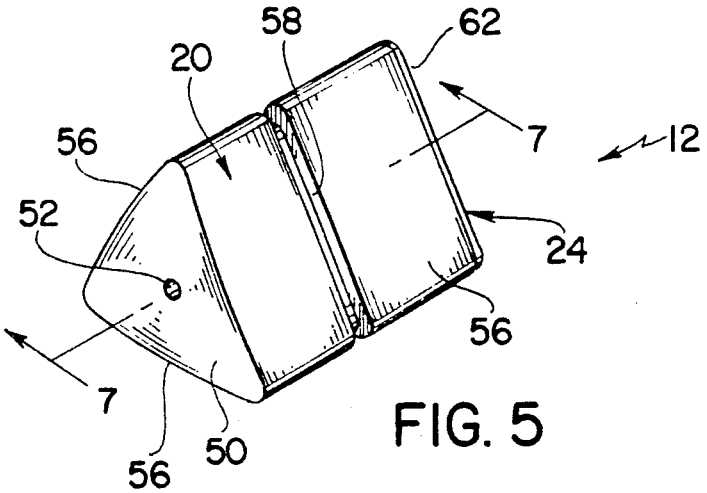
FIG. 5 is a perspective view of a second embodiment of the clutch.
Figure 6:
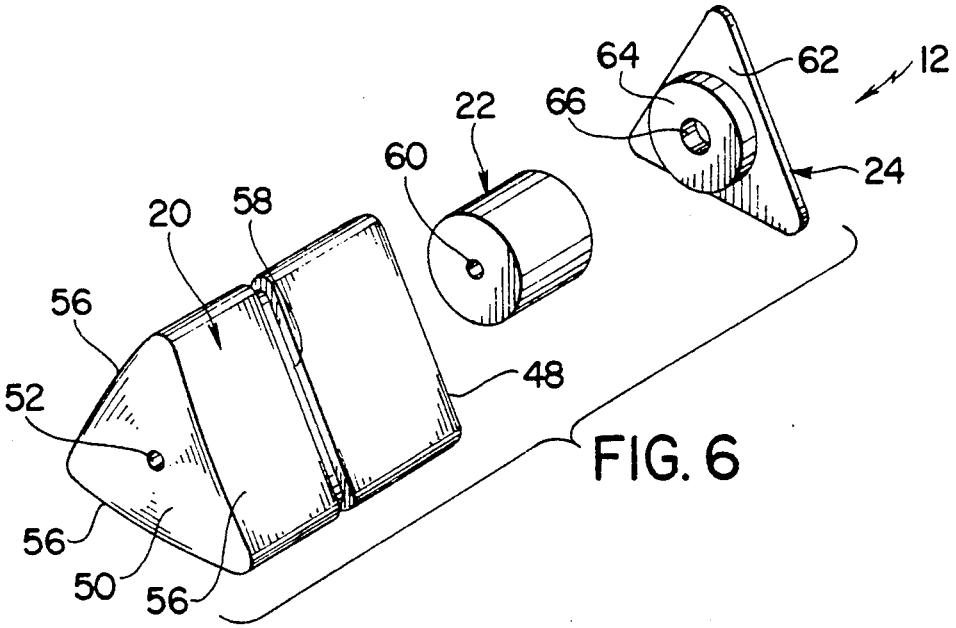
FIG. 6 is an exploded perspective view thereof.
Figure 7:
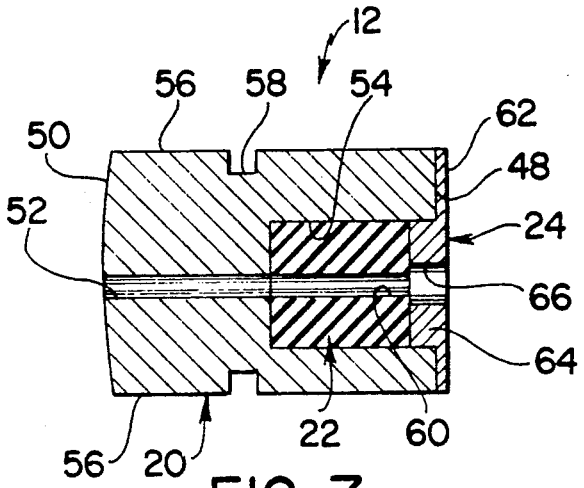
FIG. 7 is a sectional view taken along line 7—7 in FIG. 5.

Referring now to the drawings, a first embodiment of the jewelry clutch of the instant invention is illustrated and generally indicated at 10 in FIGS. 1–4, and a second embodiment of the jewelry clutch is illustrated and generally indicated at 12 in FIGS. 5–7. The clutch 10 comprises a body portion generally indicated at 14, a clutch element generally indicated at 16 in the body portion 14 and a face plate generally indicated at 18 which is secured on an end of the body portion 14. The clutch 12, on the other hand, comprises a body portion generally indicated at 20, a clutch element generally indicated at 22, and an end plate generally indicated at 24 which is received and secured on an end of the body portion 20. The clutches 10 and 12 are adapted to be easily and effectively grasped in the hands of users to facilitate assembling the clutches 10 and 12 onto the posts of various jewelry items, such as pierced earrings and the like.

The body portion 14 is preferably made from a suitable decorative metal, such as brass, and it has longitudinally extending axial bore 26 formed therein. The body portion 14 is formed in a generally triangular configuration as defined by a longitudinally extending triangular outer surface 28 which is substantially parallel to the bore 26 and therefore substantially parallel to the longitudinal axis of the body portion 14. The outer peripheral configuration of the body portion 14 as defined by the outer surface 28 is substantially equilaterally triangular, and a transversely extending groove 30 extends across the three faces of the outer surface 28 so that it extends substantially around the body portion 14. The body portion 14 has a first end 32 and a second end 34, and three notches 36 are formed in the body portion 14 in closely spaced relation to the first end 32 thereof. The notches 36 are formed in the apexes of the triangular body portions 14, and the portions of the apexes of the body portion 14 between the notches 36 and the first end 32 are formed in rounded configuration and slightly reduced dimension as illustrated most clearly in FIGS. 3 and 4. The body portion 14 also has a substantially cylindrical inner cavity 38 formed therein which extends inwardly from the first end 32.

The clutch element 16 is preferably made from a suitable elastomeric material in a substantially cylindrical configuration and it has a central or axial aperture 40 formed therein of relatively small diameter. The clutch element 16 is dimensioned to be received and secured in the cavity 38 so that the aperture 40 is aligned with both aperture 26 and the axis of the body portion 14. The aperture 40 is dimensioned for receiving and releasably securing the post of a jewelry item, such as a pierced earring in order to releasably retain the clutch 10 thereon. The face plate 18 is preferably molded from a suitable plastic material, and it comprises a main plate portion 42 of substantially triangular configuration having a central aperture 44 therein and three resilient retaining clamps 46 which are spaced in an equilaterally triangular orientation around the aperture 44. The clamps 46 are adapted to be received in the notches 36 in the body portion 14 as illustrated most clearly in FIGS. 1 and 4 in order to secure the face plate 18 to the body portion 14 so that the clutch element 16 is retained in the cavity 38. When the face plate 18 is assembled with the body portion 14 in this manner the aperture 44 is substantially aligned with the axis of the body portion 14 so that the post of a jewelry item can be assembled with the body portion 14 and the clutch element 16 by inserting the post through the aperture 44 and the face plate 18.

For use and operation of clutch 10 the body portion 14 is grasped between the thumb and first two fingers on a hand of a user. Because of the triangular configuration of the body portion 14 as defined by the outer surface 28, the body portion 14 can fit comfortably and effectively between the thumb and first two fingers in order to enable the user to effectively grasp the clutch 10. In order to further grasp the clutch 10 a fingernail of the user can be inserted into the groove 30 to even more securely hold the clutch 10. In any event, after the clutch 10 has been grasped between the thumb and fingers of a hand of a user the triangular configuration of the body portion 14 enables the clutch 10 to be more easily manipulated as the clutch 10 is assembled on the post of a jewelry item, such as a pierced earring. Further, after the clutch 10 has been assembled on the post of a jewelry item the face plate 18 provides an effective backing plate for increasing the overall surface area of the clutch 10 which engages an area, such as the backside of a user's earlobe.

Referring now to FIGS. 5–7 the clutch 12 is illustrated. As hereinabove set forth, the clutch 12 comprises a body portion 20, a clutch element 22 and an end plate 24.

The body portion 20 is generally similar in configuration to the body portion 14, and it has a first end 48 and a second end 50. The body portion 20 also has a reduced axial aperture 52 formed therein, and an inner cavity. 54 extends inwardly from the first end 48. The peripheral configuration of the body portion 20 as defined by an outer surface 56 is generally triangular, the surface 56 being substantially parallel to the axial aperture 52 in the body portion 20. The body portion 20 also includes a groove 58 which extends around the perimeter of the body portion 20 in substantially perpendicular relation to the axis thereof. However, the body portion 2? does not include notches 36 or reduced apex areas adjacent the first end 48.

The clutch element 22 is preferably similar to the clutch element 16, and it is preferably made from a suitably elastomeric material. The clutch element 22 has an axial aperture 60 therethrough which is dimensioned for snugly receiving the post of a jewelry item in order to releasably secure the post in the clutch element 22 in a conventional manner. The clutch element 22 is dimensioned to be snugly received in the cavity 54 as illustrated in FIG. 7.

The end plate 24 includes a substantially triangular plate portion 62 which is of substantially the same dimension as the first end 48 of the body portion 20, and a circular plug portion 64 which is dimensioned to be snugly received in the outer end portion of the cavity 54. The end 2, plate 24 is preferably made from a suitable plastic material, and it is secured to the first end 48 of the body portion 20 so that the plug portion 64 is received in the end portion of the cavity 54 as illustrated in FIG. 7. The end plate 24 has a central aperture 66 therethrough which is aligned with the apertures 60 and 52 when the end plate 24 is assembled with the body portion 20. The end plate 24 is preferably secured in the body portion 20, by suitable means, such as a suitable adhesive For use and operation of the clutch 12 the body portion 20 is preferably grasped between the thumb and first two fingers of a hand of a user so that it can be effectively manipulated for assembling the clutch 12 on a post of a jewelry item, such as a pierced earring. Because the body portion 20 has a substantially triangular configuration, the body portion 20 can fit firmly between the thumb and first two fingers of a hand of a user so that the clutch 12 can be easily and effectively grasped by the user. Still further, because the body portion 20 has a groove 58 formed therein, the clutch 12 can also be grasped by inserting a fingernail in the groove 58 to further secure the clutch 12 with the thumb and first two fingers of a hand of a user.

It is seen therefore that the instant invention provides an effective jewelry clutch. The clutches 10 and 12 include body portions 14 and 20, respectively, which are of substantially triangular configuration to enable the clutches 10 and 12 to be more easily grasped with the thumb and first two fingers of the hands of users. The body portions 14 and 20 also include grooves 30 and 58 which are adapted for receiving fingernails on the fingers of users to even more securely grasp the clutches 10 and 12. As a result, the clutches 10 and 12 can be effectively grasped and manipulated to assemble them onto and remove them from the posts of jewelry items, such as pierced earrings. Hence, it is seen that the jewelry clutch of the instant invention represents a significant improvement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A jewelry clutch comprising a body portion having a longitudinal axis and means for releasably receiving and securing a jewelry post in said body portion so that said post extends along said axis, said body portion having a substantially longitudinally extending outer surface, said outer surface being substantially defined by three angularly disposed longitudinally extending outer surface portions, said outer surface portions cooperating to defined a substantially triangular cross sectional configuration in said body portion along a significant continuous portion of the longitudinal extent thereof to facilitate grasping said clutch with the thumb and first two fingers of a hand of a user.

2. In the jewelry clutch of claim 1, the transverse cross sectional configuration of said body portion as defined by said outer surface further characterized as being substantially equilaterally triangular.

3. In the jewelry clutch of claim 1, said body portion having longitudinally opposite first and second ends and having a cavity formed therein which extends inwardly from said first end thereof toward said second end, said means for releasably receiving and securing a jewelry clutch comprising an elastomeric clutch element received in said cavity.

4. In the jewelry clutch of claim 1, said body portion having longitudinally opposite first and second ends, said clutch further comprising an enlarged face plate on said first end, said face plate having a central aperture therein and being received on said first end so that said aperture is substantially aligned with said axis, said face plate being of larger dimension than the transverse cross section of said body portion adjacent said first end and therefore expending outwardly beyond said outer surface adjacent said first end.

5. In the jewelry clutch of claim 1, said outer surface portions being substantially parallel to said axis.

6. A jewelry clutch comprising a body portion having a longitudinal axis and means for releasably receiving and securing a jewelry post in said body portion so that said post extends along said axis, said body portion having a substantially longitudinally extending outer surface, the transverse cross sectional configuration of said body portion as defined by said outer surface being substantially triangular to facilitate grasping said clutch with the thumb and first two fingers of a hand of a user, said body portion having a groove in said outer surface thereof, said groove extending in substantially perpendicular relation to said axis and being operative for receiving a fingernail on said hand of said user to further facilitate grasping said clutch by said user.

7. In the jewelry clutch of claim 6, said groove extending substantially entirely around said body portion.

* * * * *